US006170777B1

(12) United States Patent
Dörfel et al.

(10) Patent No.: US 6,170,777 B1
(45) Date of Patent: Jan. 9, 2001

(54) LOAD ROLL ARRANGEMENT

(76) Inventors: G. Walter Dörfel, Beethovenstrasse 21, 7325 Boll (DE); Bernd Görner, Ohrichstrasse 25, D-73235 Weilheim (DE)

( * ) Notice: Under 35 U.S.C. 154(b), the term of this patent shall be extended for 0 days.

(21) Appl. No.: 09/230,700

(22) PCT Filed: Aug. 5, 1997

(86) PCT No.: PCT/EP97/04251

§ 371 Date: Jan. 29, 1999

§ 102(e) Date: Jan. 29, 1999

(87) PCT Pub. No.: WO98/05578

PCT Pub. Date: Feb. 12, 1998

(30) Foreign Application Priority Data

Aug. 5, 1996 (DE) ..... 296 13 350 U

(51) Int. Cl.[7] ..... B65H 18/14

(52) U.S. Cl. ..... 242/541.5; 242/541.6; 242/547

(58) Field of Search ..... 242/541.5, 541.6, 242/547

(56) References Cited

U.S. PATENT DOCUMENTS 4,105,170 * 8/1978 Schonmeier ..... 242/541.5
5,165,618 * 11/1992 Ruff ..... 242/541.5
5,320,299 6/1994 Fitzpatrick et al. .

FOREIGN PATENT DOCUMENTS 2 147 673 1/1991 (DE) .
295 07 313 U 1/1995 (DE) .
WO 93/15009 1/1993 (WO) .

* cited by examiner

*Primary Examiner*—John Q. Nguyen

(57) ABSTRACT

The invention pertains to a load roll arrangement for loading a winding arrangement with one or several wound rolls on the same axis, during the winding of a web-like material, particularly paper, onto winding cores in a multiple-drum winder wherein support drums form a winding bed, in which the winding arrangement, rotating about its axis, is supported, with a support beam (60), vertically movable dependent upon the wound roll diameter, with a multipart load roll, consisting of a number of load rollers (42), which, individually with respect to the support beam (60), are vertically movable on a mounting arrangement and can be maintained in contact with the wound roll along a nip, with means for the fluid-like, particularly hydraulic, pressing of the load rollers (42) against the winding arrangement, and with an additional adjustment device, by means of which the mounting arrangements (50) of the individual load rollers (42) can be moved to different heights, independently of each other with respect to the support beam (60) according to the specifications of the resulting differences in diameter of the winding cores. In order to apply the rolls in the presence of varying wound roll diameters, due to the additional adjustment arrangement (70) of the invention, it has become possible to bring the load rolls hanging on the support beam at more greatly varying heights, and in this way to adapt the load rolls to a "diameter profile" that results along the winding bed from winding cores that differ from each other.

8 Claims, 6 Drawing Sheets

100
1
60
6
18
30
40
50
42
N
33
32
31
37
W
35
36
34

70
1
2
2'
3
4
5
6
9
10
11
12
14
23
24
25
26
A

LOAD ROLL ARRANGEMENT

The invention pertains to a load roll arrangement of the type corresponding to the preamble of claim 1.

Such a load roll arrangement can be found in DE 21 47 673 A1. The support drums, in the manner typical of two-drum winding arrangements, have the same diameter and are arranged side by side at the same height in such a way that a winding core, placed from above into the winding bed, formed by the gap between the two support drums, cannot fall between the support drums. The placement of the winding cores is carried out manually or with a suitable device. The paper web comes from a roll cutting machine in which the web, having the width of the paper machine, is divided into more narrow lengths, as is customary, for example, in newspaper printing or other uses. The winding cores are as long as the individual partial webs are wide. They are placed into the winding bed while successively butting against each other and form a so-called winding core set. The beginnings of the partial webs are glued to the winding cores, whereupon the support drums begin to move and the winding cores, onto which the individual windings are wound, begin to turn. The winding cores or the wound roll are pressed down into the winding bed by means of an arrangement of load rolls in order to ensure, particularly during the initial phase, a good engagement of the wound rolls that are forming and in the later phase, a perfect formation of the wound rolls.

The load roll arrangement consists of many individual rolls succesively arranged in transverse direction with respect to the web, which rolls are pivotably mounted on arms and rest on top of the wound rolls independently of each other. In this way, a uniform resting on all wound rolls or a deliberately uneven resting can be achieved.

The arms of the load rolls are arranged at a support beam, provided centrally above the support drums, which can be raised and lowered vertically and which, in the initial phase, is lowered closely above the support drums and rises with an increasing wound roll diameter.

Not too long ago, it was customary for the winding cores of a set to have the same diameter. Lately, however, it is required that within a winding core set, winding cores of varying diameters may also be used. The conventional load roll arrangements have indeed a certain adaptability and, by means of an appropriate swiveling motion of the support arms, are able to handle differences in height, i.e., differences of up to 35 mm in diameter of the winding cores placed in the winding bed.

However, this is insufficient in the case of the newer requirements. There is a need for arrangements in which simultaneously winding cores with a diameter of 100 mm or 120 mm and a diameter of 180 mm can be used.

Working with a set of individual winding cores having such varying diameters has been possible thus far on carrying rolls with individual winding stations facing each other.

It is the object of the invention to create a load roll arrangement of this type in such a way that on the corresponding multiple-drum, preferably two-drum, winding arrangement winding cores with greater differences in diameter can be used.

This object is solved by means of the invention disclosed in claim 1.

While in the case of the conventional two-drum winding arrangements, at a certain height of the support beam, only 35 mm of lift was available which is possible within the bounds of normal pressure application of the load rolls. In order to apply the load rolls in the presence of varying wound roll diameters, due to the additional adjustment arrangement of the invention, it has become possible to bring the load rolls hanging on the support beam at more greatly varying heights, and in this way to adapt the load rolls to a "diameter profile" that results along the winding bed from winding cores that differ from each other. When the respective core has a smaller diameter, the load roll arrangements located within its longitudinal area are lowered further. In the case of greater diameters, the load rolls are raised. Thus, on all winding cores of varying size, a resting is possible without confinement to the limitations of the range of tolerance of the normal load roll arrangement.

Particularly, the adjustment arrangement in accordance with claim 2 may comprise individual adjustment units that engage the respective mounting arrangement. The mounting arrangement is a structural unit that comprises, respectively, a carrier for the support arms that can be swiveled up and down, the support arms themselves and the force member that, while the support arms are swiveled, press the respective load roll onto the wound roll.

Structurally, the simplest approach is displacement of the mounting arrangement with respect to the support beam on a slide guide.

For this purpose, it may be advantageous for the displacement to occur with the aid of a connecting rod in the manner indicated in claim 4.

In the normal position, the respective mounting arrangement takes the highest position in which it is resiliently held in accordance with claim 5, for example, by means of a helical spring in accordance with claim 6.

The advance of the connecting rod, in accordance with claim 7, may take place by means of a control element present in each adjustment unit which, according to claim 8, is in the form of a cam plate.

Accordingly, on the upper surface of the support beam, a number of cam plates corresponding to the number of adjustment units, are present.

A structurally simple solution for driving these cam plates is the common adjustment shaft on which all cam plates are rotatably mounted and which via drag levers are engaged selectively by the cam plate or not, depending on whether the latch connecting both is engaged or not.

The adjustment shaft does not rotate continuously but merely covers a pivot angle range of, for example 270°, wherein the one critical angle causes the connecting rod to be lifted and a height adjustment of the load roll which, for example, corresponds to the greatest existing winding core diameter and the other limit is laid out correspondingly for the smallest winding core diameter.

By utilizing intermediate angle positions, an adaptation to intermediate diameters can take place.

In the drawing, an example of the invention is shown.

Figure 1:
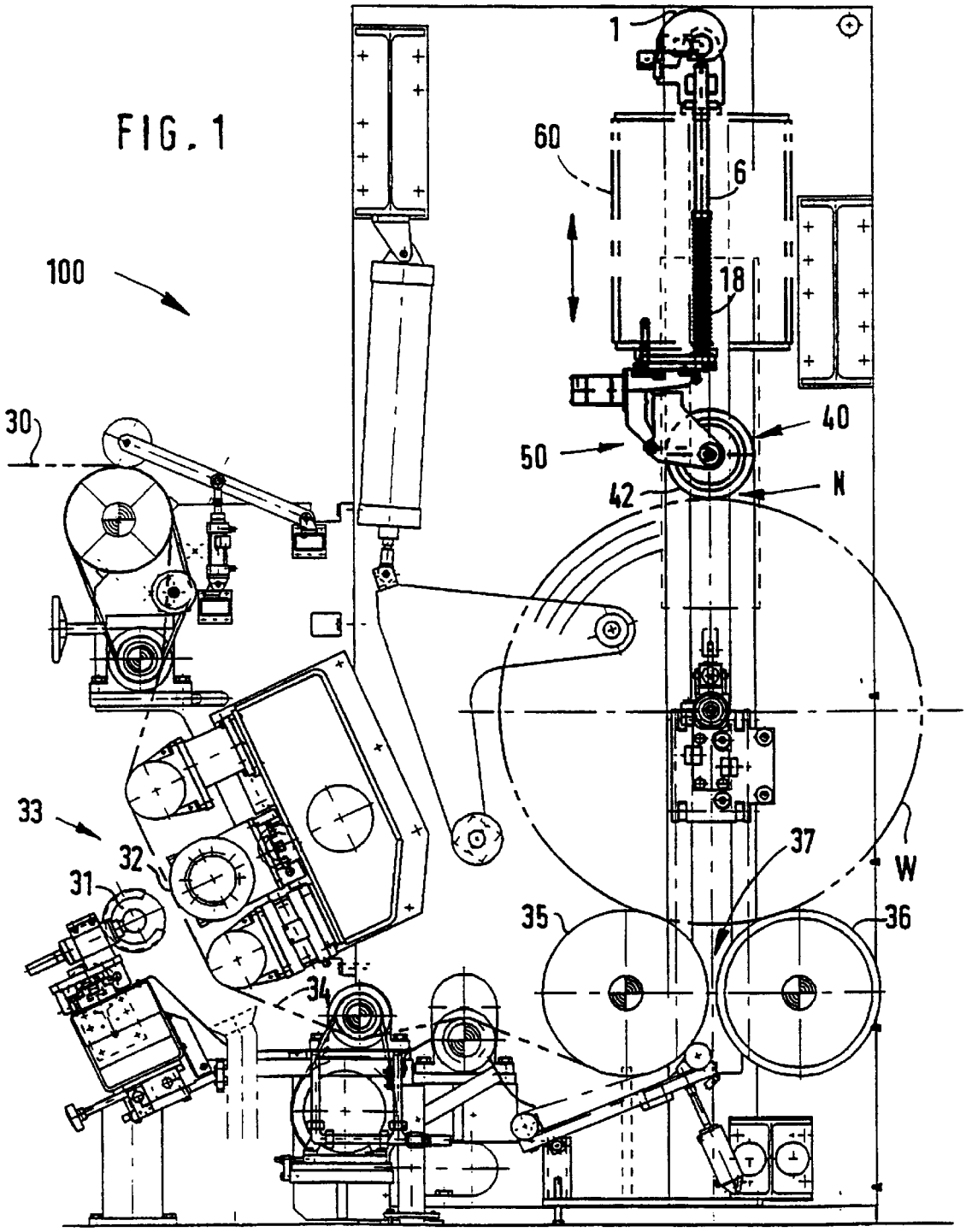
FIG. 1 shows a partially schematized side view of a roll cutting machine.

The roll cutting machine, represented overall by 100 in FIG. 1, serves for separating an incoming paper web 30, having the width of the paper machine, into individual narrower webs 34, and by means of the roll cutting device, having a pair of circular cutters 31, 32 and represented overall by 33, wherein the individual narrower webs, separated as a result of the longitudinal cuts, continue to pass directly adjacent to one another through the roll cutting machine 100, over and around the left of the two parallel extending support drums 35, 36, having the same diameter and arranged at the same height, onto the wound rolls W, which are forming directly side by side but separately on the two support drums 35, 36 that extend across the width of the original paper web 30.

The wound rolls W are wound to diameters on the order of 1.5 m on so-called winding cores in the form of strong cardboard tubes with outer diameters of approximately 100 to 200 mm. The winding cores are placed, in a manner yet to be explained by means of FIGS. 3 and 4, into the winding bed 37, either manually or with an appropriate device, are joined with the beginnings of the web, for example, by gluing, and are then made to rotate by means of the drive of the support drums 35, 36, on which they are supported. In order to ensure at that point a sufficient engagement of the winding cores or of the wound rolls W to be formed, there rests on the winding cores along a nip N a multipart load roll 40, arranged symmetrically above the support drums 35, 36 and parallel to the support drums 35, 36 which can be lifted and lowered in accordance with the winding operation in progress, in the direction of the arrow and with respect to a horizontal support beam 60 extending diagonally across the web width.

The load roll, represented overall by 40, having in the example a diameter of approximately 300 mm, consists of individual load rollers 42 in sequence in the longitudinal direction of the load roll and adjacent to each other and whose widths are only at most half their diameter.

Figure 2:
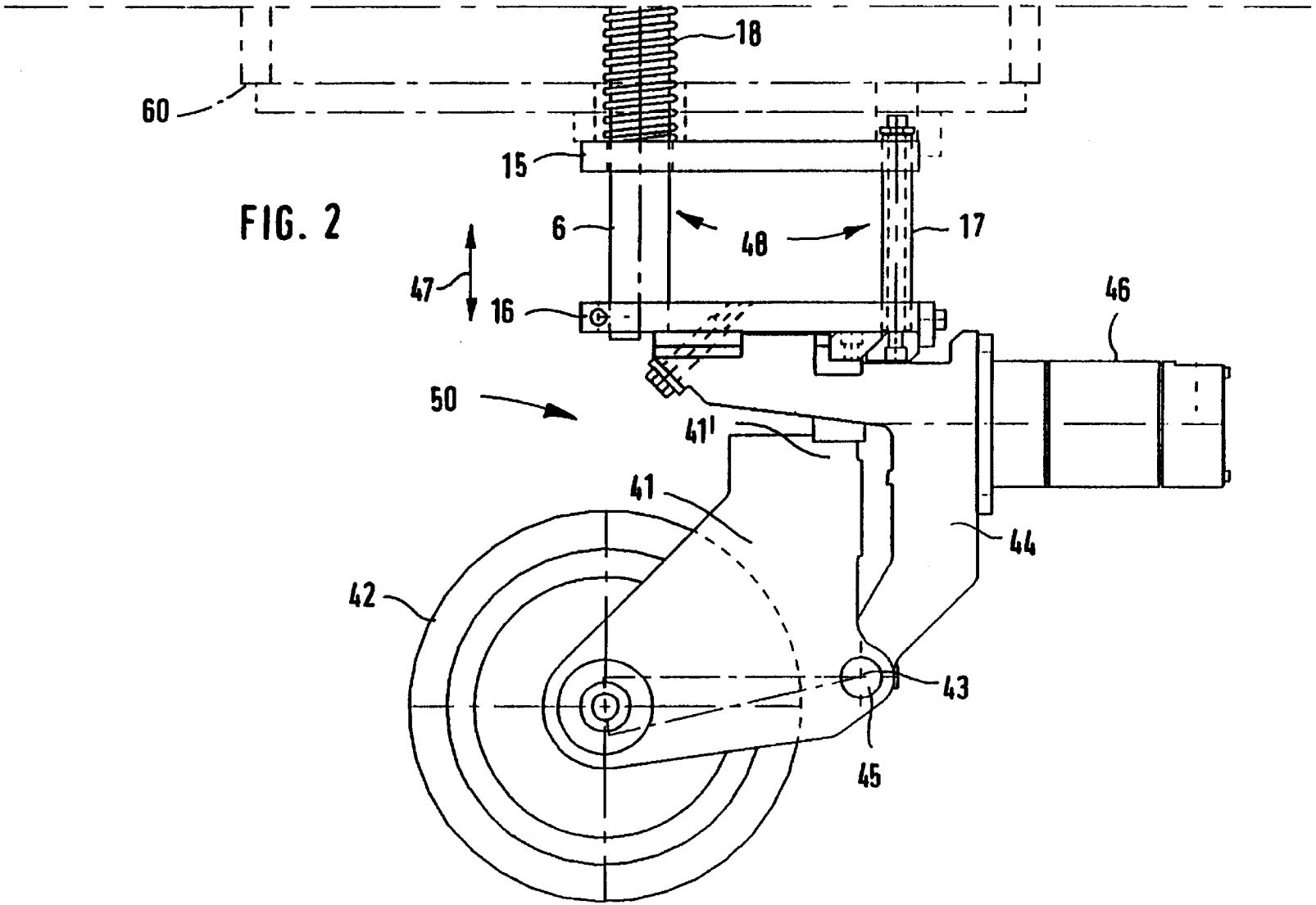
FIG. 2 shows a view of an individual load roll which, with respect to FIG. 1 is shown in reverse arrangement.

As can be seen in FIG. 2, each individual load roller 42, independently of the other load rollers, can be swiveled up or down on bearing cheeks 41, arranged on both sides about a horizontal swivel axis 43 located outside the periphery of the load roller 42. The stub axle 45 with the swivel axis 43 is arranged at a carrier 44, which extends upwardly from the swivel axis 43 and carries at a distance, above the swivel axis 43, a horizontally effective force member 46, for example, a fluid cylinder, which acts against the end 41' of the bearing cheeks 41, located above the swivel axis 43, and by means of which the bearing cheeks 41 can be swiveled about a limited angle that approximately corresponds to a vertical lift of the load rollers 42 by up to 35 mm. The load force of the load rollers 42 on the wound rolls W is determined by the force of the force member 46 and can be controlled in this manner.

The carrier 44 is attached to a horizontal mounting plate 16 that can be raised and lowered in the direction of the arrow 47 with respect to the support beam 60. The entire structural unit consisting of bearing cheeks 41, carrier 44 and mounting plate 16 can be described as a mounting arrangement 50 that can be raised and lowered in the direction of the arrow 47. The mounting arrangement 50 is guided on a slide guide 48, which comprises a vertical connecting rod 6 that with its lower end grips into a bore hole of the mounting plate 16 to which it is clamped. At a horizontal distance from the connecting rod 6, at the right end of the mounting plate 16, pilots 17 are attached which support the guide.

At the underside of the support beam 60, a guide plate 15 is rigidly arranged through which the connecting rod 6 and the guide pilot 17 grip and which affects their slide guide.

The mounting arrangement 50 with the load rollers 42 may be raised in the direction of the arrow 47 with respect to the lowest position shown in FIG. 2 until the mounting plate 16 rests against the guide plate 15.

Figure 4:
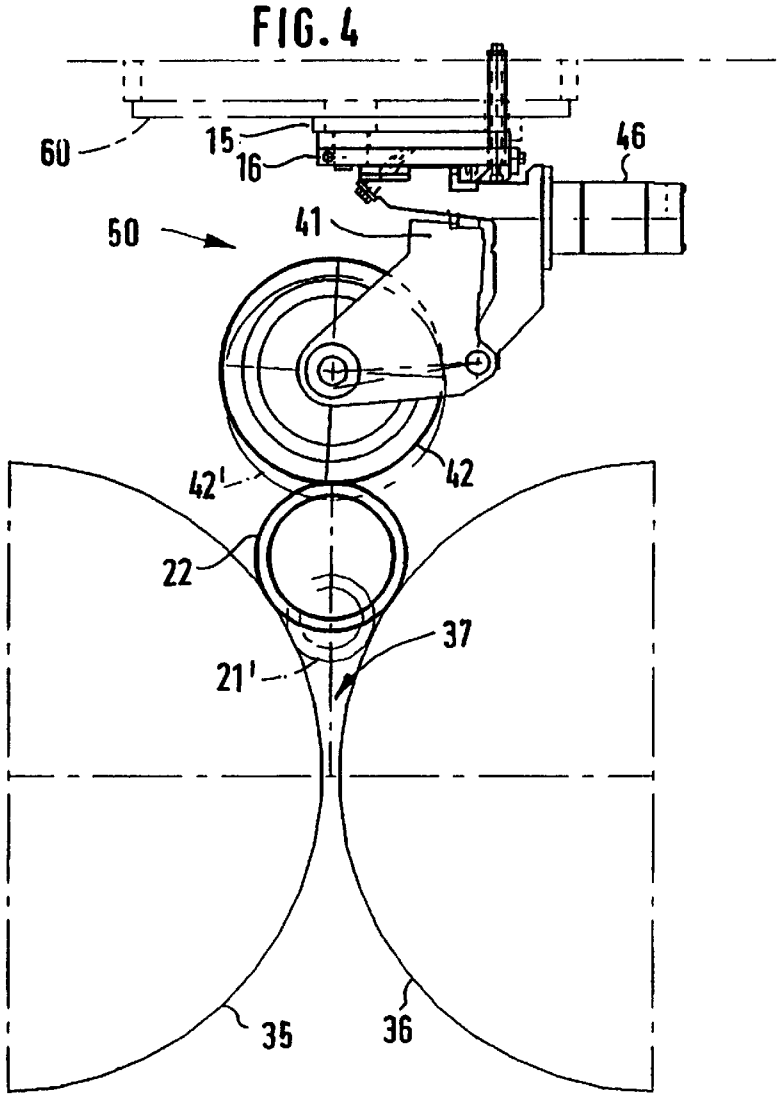
FIGS. 3 and 4 show enlarged representations from FIG. 1 from the area of the support drums.
Figure 3:
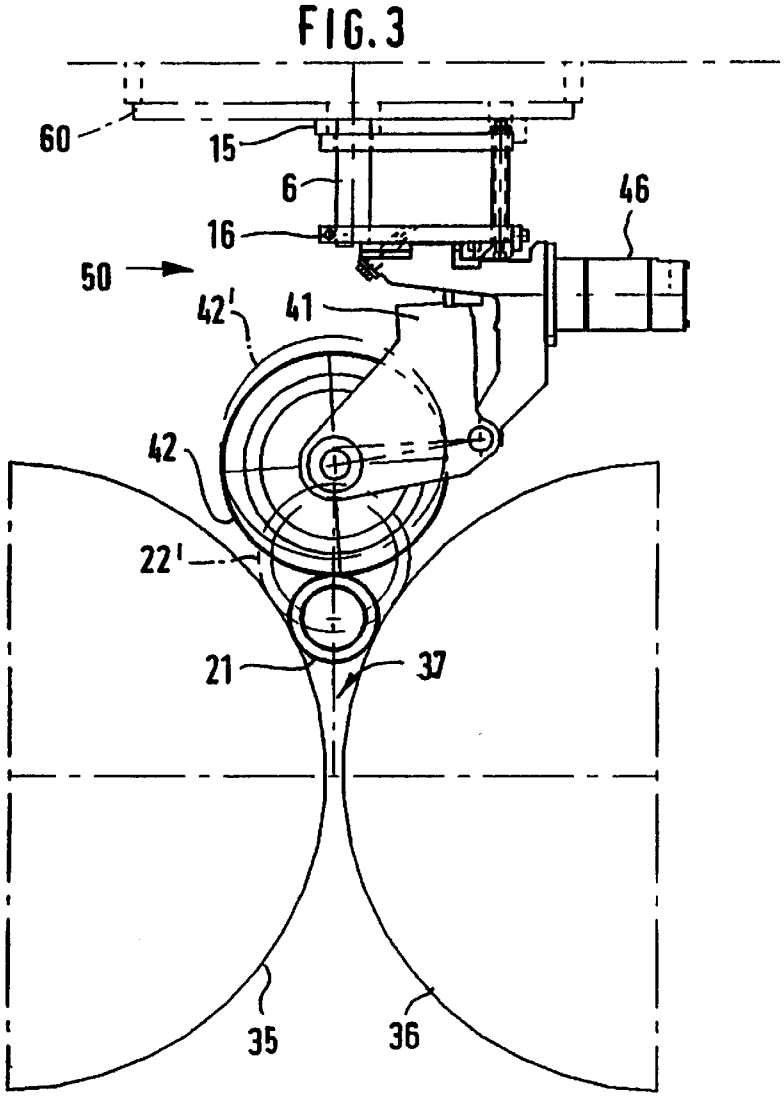

The significance of this step is illustrated by means of FIGS. 3 and 4, which reflect the conditions that exist at the start of the winding process.

The problem lies in that in one and the same set of winding cores, i.e., a group of winding cores extending along the winding bed 37, for the partial webs produced by the roll cutting machine 33, there occur winding cores with a smaller diameter of approximately 100 or 120 mm, as represented by 21 in FIG. 3, as well as winding cores with a greater diameter of up to 200 mm, as indicated in FIG. 3 in the form of a segmented line and represented by 22'. In FIG. 4, the small winding cores are indicated with broken lines and represented by 21' and the large winding cores 22 are shown in the form of unbroken lines.

In FIG. 3, the load roller 42 rests on the small winding core 21. The normal position of the mounting arrangement 50 is indicated at 42'. In contrast thereto, the load roller 42 is moved downward by appropriately applying the maximally achievable lift to the force member 46.

In FIG. 4, the corresponding arrangement for the large winding cores 22 is shown. The load roller 42 rests on this winding core 22. With respect to the normal position 42', it is moved upward by the appropriate application of the maximally achievable lift to the force member 46.

It is apparent that only with the relatively small lifting, achievable by means of the force members 46, at a certain height of the support beam 60, load rolls 42 cannot rest simultaneously on winding cores 21 of a small diameter and winding cores 22' of greater diameter. When the load rollers 42 rest on the smaller or larger winding cores 21 or 22, the adjacent load rollers 42 do not reach the respective other winding cores 22 or 21.

In order to overcome this problem, the mounting arrangement 50 of each individual load roller 42 can also be adjusted individually, i.e., from the lowest position, shown in FIG. 3, to an upper position shown in FIG. 4. In the example shown, the lift between the two positions is approximately 90 mm, to which the small lift of the load rollers 42, due to swiveling of the bearing cheeks 41, may be added.

In the FIGS. 5 to 9, it is shown how the lift of the individual mounting arrangements in the direction of the arrow 47 is achieved.

Figure 5:
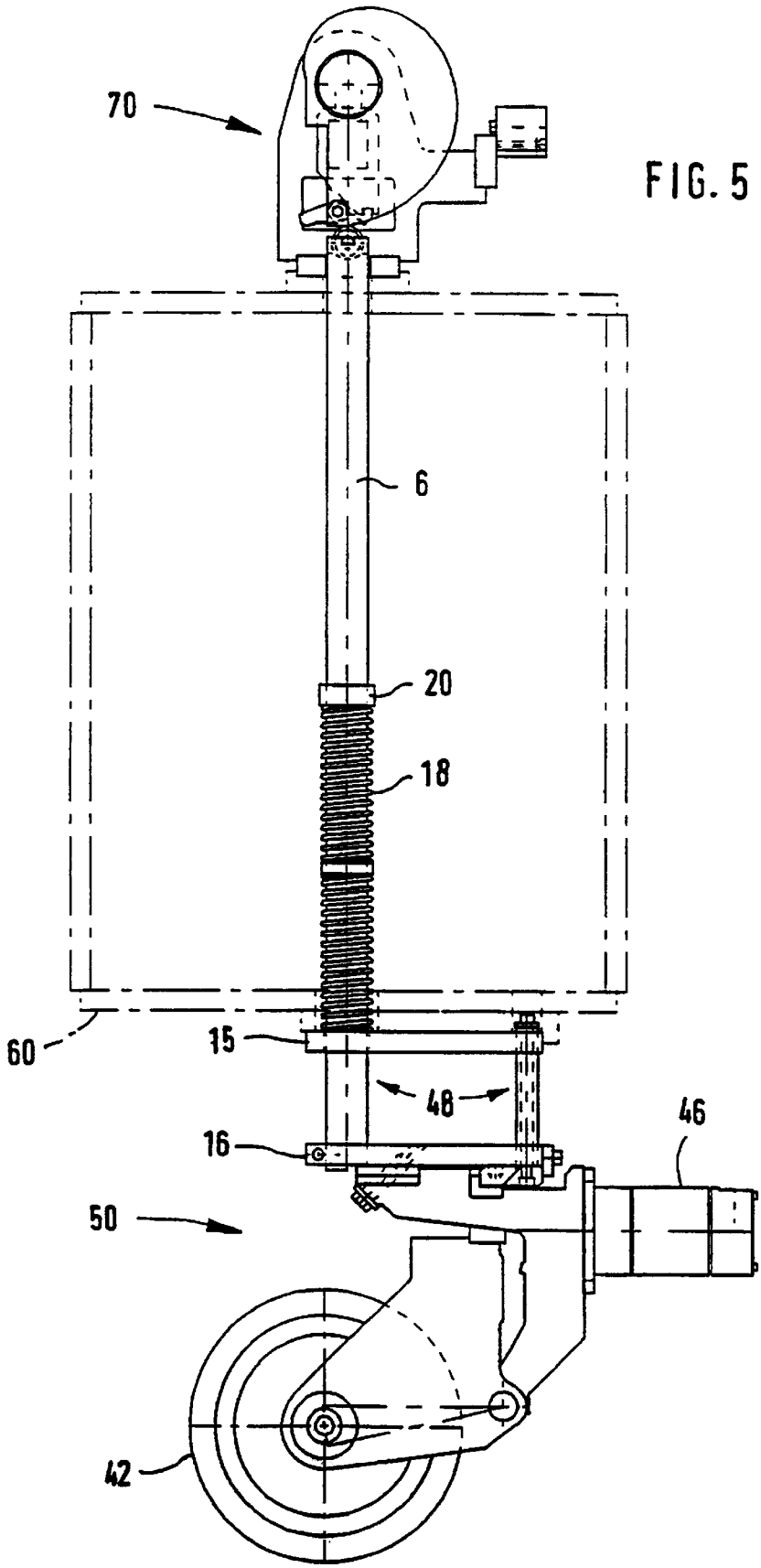
FIGS. 5 and 6 show enlarged representations of FIG. 1 from the area of the support beam.
Figure 6:
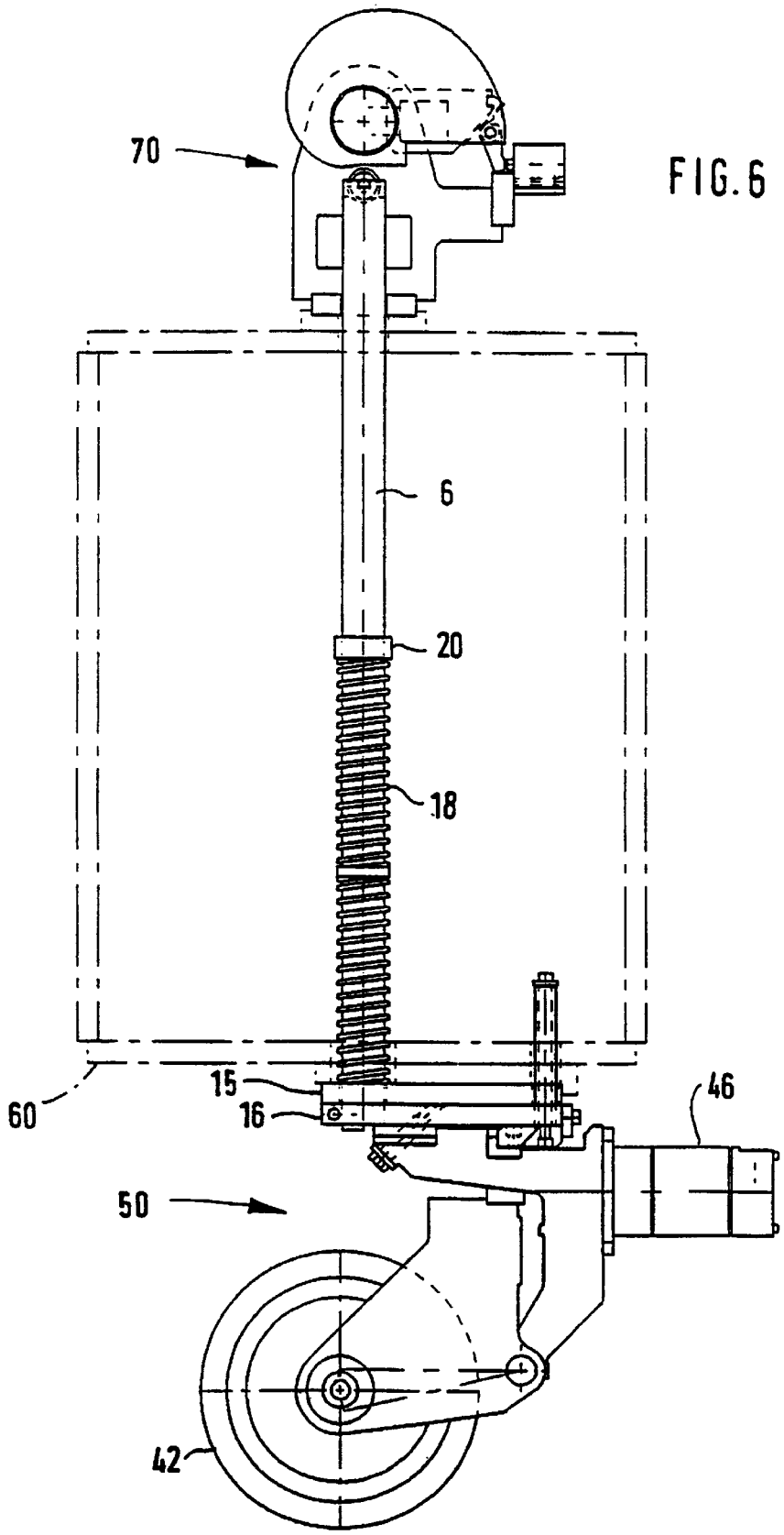

In accordance with the FIGS. 5 and 6, the respective connecting rod 6, serving for the purpose of guiding and lifting the mounting arrangement 50, vertically grips through the support beam 60, which is in the form of a box support. In the lower area, the connecting rod 6 is surrounded by a helical spring 18 that, with its lower end, supports itself on the upper surface of the guide plate 15 and with its upper end supports itself against a support 20 at the connecting rod 6. The helical spring 18 assures that the mounting arrangement 50 is normally located in the lifted position shown in FIG. 6.

While the mounting arrangement 50 with its slide guide 48 is arranged at the underside of the support beam 60, the adjustment unit 70, assigned to each mounting arrangement 50, is located on the upper surface of the support beam 60. The adjustment unit 70 transfers its lift via the connecting rod 6 to the mounting arrangement 50.

Figures 7, 8, 9:
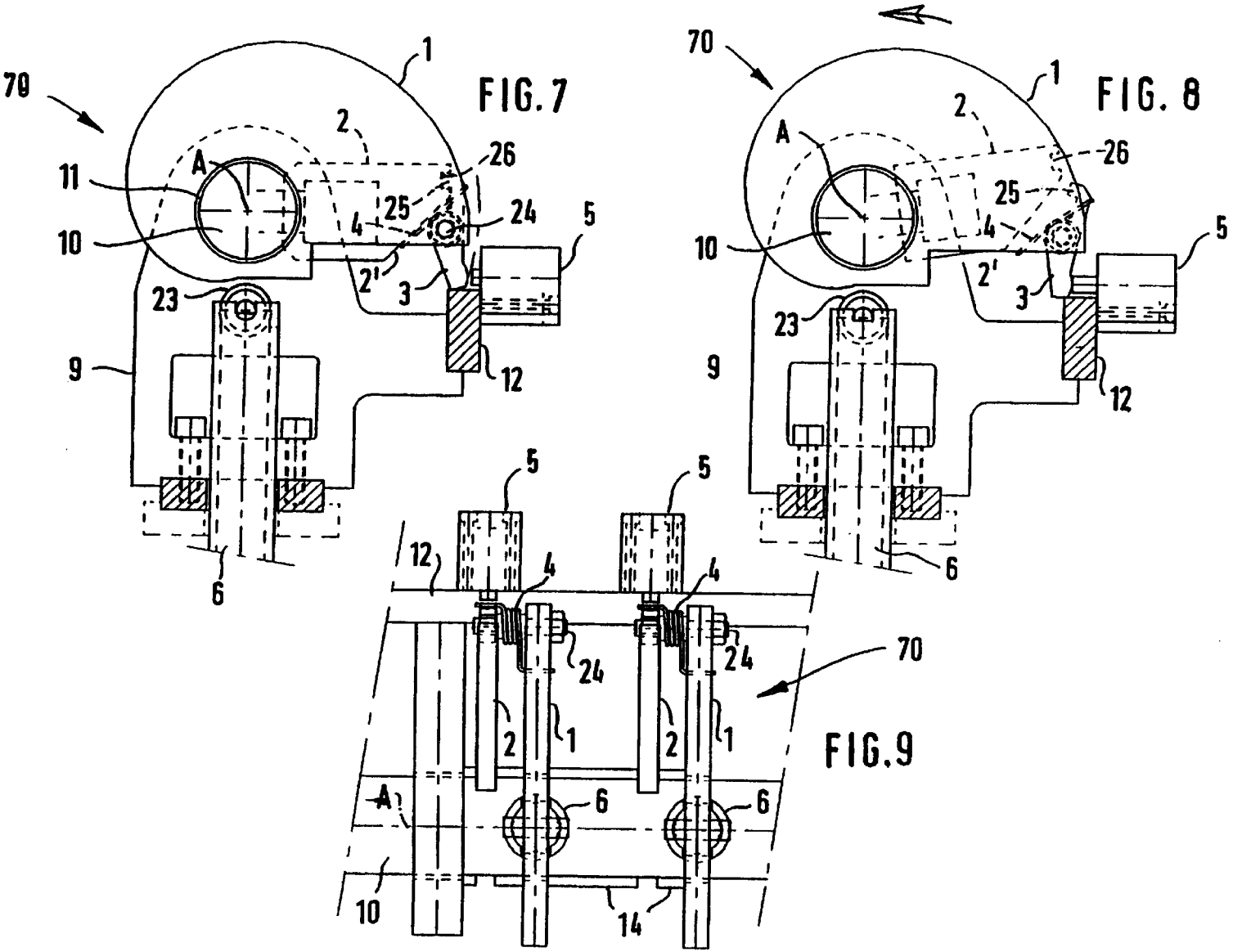
FIGS. 7 and 8 show again enlarged representations in accordance with FIG. 1 from the area of the cam plates.
FIG. 9 shows a partial view in accordance with FIG. 7 from above.

The formation of the adjustment units 70 becomes apparent in detail in the FIGS. 7 to 9. Each adjustment unit comprises a cam plate 1 with a latch 3, rotatably mounted on it. A cam plate 1 is assigned to each load roller 42. All cam plates 1 are rotatably mounted on an adjustment shaft 10 that extends along the support beam 60 and is arranged above the upper end of the connecting rods 6. The upper end of the connecting rods 6 carries a roll 23, which is intended to engage with the periphery of the cam plate 1.

In the case of the position shown in FIG. 7, the greatest radial distance of the periphery of the cam plate 1, in accordance with FIG. 7, is present to the right of the adjustment shaft 10. The distance decreases proportionately with the angle of rotation in the counterclockwise direction.

The mounting of the latch 3 on the bearing pin 24 is in the area of the greatest radial distance of the cam plate 1. The latch 3 is in the form of a two-armed lever, whose extension 25, located at the end of the upper lever in FIG. 7, points in the radially inward direction with respect to the adjustment shaft 10.

Laterally, next to each cam plate 1, axially adjacent to same, with the adjustment shaft 10, a drag lever 2 is connected without rotational play (FIG. 9) which is located in the same plane, perpendicular to the axis A of the adjustment shaft 10 as the latch 3 and has a recess 26 on its outer boundary surface into which the extension 25 of the latch 3 grips. On the bearing pin 24 of the latch 3, a leg spring 4 is arranged which normally presses the latch 3 with its extension 25 into the recess 26 of the drag lever 2. The cam plates 1 are fixed in the axial direction of the adjustment shaft 10 by means of spacer sleeves 14, which rest laterally against the drag levers 2.

In front of the free end of the other lever arm of the latch 3, a control element in the form of a short-stroke cylinder 5 is fixed, i.e., connected to the support beam 60, that, during operation in the manner visible in FIG. 8, moves the latch 3 in such a way that its extension 25 no longer engages the recess 26 of the drag lever 2.

The adjustment shaft 10 is supported several times in bearing blocks 9 on the upper surface of the support beam 60 and is rotatably mounted via friction bearings. The adjustment shaft 10 is turned back in the counterclockwise direction by means of a rotary drive unit, (not shown) located at its free end, by a maximum of 270° in accordance with the FIGS. 7 and 8.

At the beginning of the rotation, starting with the conditions according to FIG. 7, one portion of the short-stroke cylinders 5 is controlled and another portion is not, depending on whether the respective cam plate 1 is located above a winding core 21 with a small diameter or a winding core 22 with a larger diameter.

The "activated" cam plates 1, where the short-stroke cylinder 5 has not been operated and which hence are rotatably connected via the latch 3 with the respective drag lever 2, also turn during the rotation of the adjustment shaft 10 and press the assigned connecting rods via the rolls 23, and hence the respective mounting arrangements 50, in a downward direction. During the rotation of the adjustment shaft 10, the nonactivated cam plates 1 are not turned but are at a standstill, so that also the assigned connecting rods 6 remain in their upper position that, according to FIG. 4, is adapted to the winding cores 22 with the greater diameter.

Which of the cam plates 1 are "activated" in the individual case depends on the actual set of winding cores, i.e., on the order of the winding cores 21, 22, with the smaller or greater diameter and its length. The appropriate data reach the control that "activates" the accompanying cam plate 1 for all load rollers 42 that are located within the longitudinal extension of a winding core 21 with a smaller winding diameter, in order to move the appropriate mounting arrangement from the position according to FIG. 4 into that according to FIG. 3.

With the arrangement shown, only two different diameter sizes of winding cores within a winding core set can be managed. In practice, however, more than two winding core sizes do not occur. The adjustment of the mounting arrangements 50 need not necessarily correspond to the outermost angle positions of the cam plate 1, which are assigned to the maximally smallest or greatest occurring winding core diameters. Perhaps, in addition to the initial position shown in the FIGS. 7 and 8, which corresponds to the greatest winding core diameter, it would be possible to use an intermediate position of the angle of rotation of the adjustment shaft 10, in which the engaged cam plates 1 are held. This intermediate position then corresponds to a central diameter of a winding core.

If, upon completion of the rotation of the adjustment shaft 10, each adjustment unit 70 has positioned the accompanying load roller in accordance with the actual winding core set, all controlled short-stroke cylinders 5 (above the large winding cores 22) are switched without power. The respective latch 3 remains pressed via the leg spring 4 against the retracted ram of the short-stroke cylinder 5 and, at that point, extends with its lower end across a rail 12 on which it supports itself and thereby fixes the accompanying cam plate 1 in its position. In this position (short-stroke cylinder 5 unpowered) also the drag levers 2, engaged during the turning back of the adjustment shaft 10, again automatically engage the accompanying latches 3 in the zero-degree position, wherein they press the same via their lower incline 2' towards the side until the extension 25 of the latch 3 can snap into the recess 26.

The assembly of all elements taking part in the selection of the load rolls 42 to be moved is such, that the assumed condition is necessarily maintained and, after one winding cycle, again returns automatically to the basic position, in which all drag levers 2 are connected in a rotating manner with their cam plates 1.

The start of the winding is shown in FIGS. 3 and 4. With the greatest and smallest diameters of the winding cores, in addition to the adjustment via the adjustment units 70, also the possible lift of the mounting arrangements is utilized, as can be seen in the FIGS. 3 and 4 by means of the actual position of the load rollers 42, represented by the deviation from the normal central position 42' of the unbroken lines. With starting of the winding, the partial webs 34 wind onto the winding cores 21, 22 and increasingly enlarge the outer diameter at the wound roll. At that time, the rule applies wherein after any desired time, an equal surface increase always occurs on each winding core, whether large or small, since during a constant winding speed also the same web lengths have been wound to the same thickness. In practical terms, this means that at the start of the winding, the initial difference in diameter, based on the differences in the diameter of the winding cores 21, 22 is quickly reduced. At roughly 900–1000 m reel diameter, the remaining differences between the smaller or larger winding cores 21, 22 are so small that the adjustment units 70, starting with this area, can again assume their zero-degree position and all of the mounting arrangements 50 rest again against the respective guide plate 15 at the underside of the support beam 60.

The withdrawal of the additional lift of the adjustment units 70, adapted to the increase in diameter of the wound rolls W, takes place in the following manner: the load roll 40 or the support beam 60 with all attaching parts receives its reference position from the wound rolls W with large winding cores 22, on which it rests in a power-controlled or power-regulated manner. This position is determined by means of a position measurement. Since the increase in area in the above-mentioned manner is known and thus also the respective difference in diameter, it is possible to turn the adjustment shaft 10, via a control program in appropriate timed angle steps, back to the initial zero position.

The adjustment device, comprising the adjustment units 70, is an additional arrangement that can be integrated in existing load arrangements with individual load rollers, which are arranged closely side by side, without the need to alter the load rollers with their suspensions or the accompanying control of the support beam.

List of Reference Numbers

| | | | |
|---|---|---|---|
| 1 | Cam plate | 42' | Normal Position |
| 2, 2' | Drag lever | 43 | Swivel axis |
| 3 | Latch | 44 | Carrier |
| 4 | Leg spring | 45 | Stub axle |
| 5 | Short-stroke cylinder | 46 | Force members |
| | | 47 | Arrow |
| 6 | Connecting rod | 48 | Slide guide |
| 9 | Bearing blocks | 50 | Mounting arrangement |
| 10 | Adjustment shaft | 60 | Support beam |
| 12 | Rail | 70 | Adjustment unit |
| 14 | Spacer sleeves | 100 | Rolling cutting machine |
| 15 | Guide plate | A | Axis |
| 16 | Mounting plate | W | Wound rolls |
| 17 | Guide pilot | N | Nip |
| 18 | Helical spring | | |
| 20 | Support | | |
| 21, 21' | Small winding core | | |
| 22, 22' | Large winding core | | |
| 23 | Roll | | |
| 24 | Bearing pin | | |
| 25 | Extension of latch | | |
| 26 | Recess of drag lever | | |
| 30 | Paper web | | |
| 31 | Circular cutter | | |
| 32 | Circular cutter | | |
| 33 | Roll cutting device | | |
| 34 | Narrower web | | |
| 35 | Support drum | | |
| 36 | Support drum | | |
| 37 | Winding bed | | |
| 40 | Multipart load roll | | |
| 41 | Bearing cheeks | | |
| 41' | End of bearing cheek | | |
| 42 | Load rollers | | |

What is claimed is:

1. Load roll arrangement for loading a winding arrangement with one wound roll, during the winding of a web-like material onto winding cores in a multiple-drum winder that comprises support drums, rotating about horizontal axes, which are parallel to each other and closely arranged side by side, wherein the support drums form a winding bed, in which the winding arrangement, rotating about its axis, is supported, with a support beam with drive means for moving the support beam vertically depending on the wound roll diameter, with a multipart load roll, essentially parallel to the axes of the support drums, consisting of a number of load rollers, which, individually with respect to the support beam, are vertically movable on a mounting arrangement and can be maintained in contact with the wound roll along a nip and with means for the fluid-like pressing of the load rollers against the winding arrangement, characterized by an additional adjustment device, by means of which the mounting arrangements of the individual load rollers can be moved to different heights between upper and lower positions, independently of each other with respect to the support beam according to the specifications of the resulting differences in diameter of the winding cores along a slide guide by means of the adjustment device, with the adjustment arrangement for each individual load roller comprising an adjustment unit, engaging the respective mounting arrangement and the vertical displacement of the mounting arrangement respectively takes place by means of one connecting rod, vertically gripping through the support beam, displaced by the adjustment unit, and engaging the mounting arrangement, with the mounting arrangement pressed in a resilient manner into the mounting arrangement upper Position adjacent to the support beam.

2. Load roll arrangement, in accordance with claim 1, characterized in that the connecting rod is surrounded in the interior of the support beam by a helical spring that, at the lower end supports itself at the support beam and at the upper end at an abutment on the connecting rod.

3. Load roll arrangement, in accordance with claim 1, characterized in that each adjustment unit comprises an control element effecting a controllable advance of the connecting rod.

4. Load roll arrangement, in accordance with claim 3, characterized in that each control element comprises a cam plate, rotatable about an axis that is parallel to the axes of the support drums and effecting a controllable advance on the upper end of the connecting rod.

5. Load roll arrangement, in accordance with claim 4, characterized in that for all cam plates, a common adjustment shaft is provided which simultaneously serves as a pivot bearing of the cam plates and which selectively can be rotatably connected to the individual cam plates.

6. Load roll arrangement, in accordance with claim 5, characterized in that at the adjustment shaft, for each cam plate, respectively, one drag lever is mounted without rotational play, which can be coupled to the cam plate by means of a latch.

7. Load roll arrangement, in accordance with claim 5, characterized in that the adjustment shaft can be driven via a pivot angle range, whose limit angles correspond to the winding cores with the smallest or greatest diameters.

8. Load roll arrangement, in accordance with claim 7, characterized in that by means of starting in intermediate positions of the pivot angle range of the cam plates, an adaptation to intermediate sizes of the winding cores takes place.

* * * * *